US011230745B2

(12) United States Patent
Lee

(10) Patent No.: US 11,230,745 B2
(45) Date of Patent: *Jan. 25, 2022

(54) NON-ORIENTED ELECTRICAL STEEL SHEET AND MANUFACTURING METHOD THEREFOR

(71) Applicant: POSCO, Pohang-si (KR)

(72) Inventor: Se Il Lee, Pohang-si (KR)

(73) Assignee: POSCO, Pohang-si (KR)

( * ) Notice: Subject to any disclaimer, the term of this patent is extended or adjusted under 35 U.S.C. 154(b) by 123 days.

This patent is subject to a terminal disclaimer.

(21) Appl. No.: 16/065,783

(22) PCT Filed: Dec. 23, 2016

(86) PCT No.: PCT/KR2016/015233

§ 371 (c)(1),
(2) Date: Jun. 22, 2018

(87) PCT Pub. No.: WO2017/111554

PCT Pub. Date: Jun. 29, 2017

(65) Prior Publication Data

US 2019/0017136 A1 Jan. 17, 2019

(30) Foreign Application Priority Data

Dec. 23, 2015 (KR) ..... 10-2015-0185428

(51) Int. Cl.
*C22C 38/02* (2006.01)
*C21D 8/12* (2006.01)
(Continued)

(52) U.S. Cl.
CPC ..... *C21D 8/1272* (2013.01); *C21D 8/12* (2013.01); *C21D 8/1222* (2013.01);
(Continued)

(58) Field of Classification Search
CPC ..... C21D 9/46; C22C 38/02
See application file for complete search history.

(56) References Cited

U.S. PATENT DOCUMENTS

2005/0000596 A1* 1/2005 Schoen ..... C21D 8/1222 148/111
2017/0362676 A1* 12/2017 Lee ..... C22C 38/60
2020/0087748 A1* 3/2020 Lee ..... H01F 1/14775

FOREIGN PATENT DOCUMENTS

CN 104674136 A 6/2015
EP 2910658 A1 8/2015
(Continued)

OTHER PUBLICATIONS

European Office Action dated Jun. 4, 2019 issued in European Patent Application No. 16879421.2.
(Continued)

*Primary Examiner* — Jophy S. Koshy
(74) *Attorney, Agent, or Firm* — Morgan, Lewis & Bockius LLP

(57) ABSTRACT

A non-oriented electrical steel sheet according to one embodiment of the present invention comprises, by weight, 1.0% to 4.0% of Si, 0.001% to 0.01% of Al, 0.002% to 0.009% of S, 0.01% to 0.3% of Mn, 0.001% to 0.004% of N, 0.004% or less (0% exclusive) of C, 0.003% or less (0% exclusive) of Ti, 0.005% to 0.07% of Cu, 0.05% to 0.2% of either or both of Sn and P, and a balance amount of Fe and impurities.

9 Claims, 4 Drawing Sheets

(51) Int. Cl.

| | |
|---|---|
| ***C22C 38/04*** | (2006.01) |
| ***C22C 38/06*** | (2006.01) |
| ***C22C 38/14*** | (2006.01) |
| ***C22C 38/16*** | (2006.01) |
| ***C22C 38/60*** | (2006.01) |
| ***C22C 38/00*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |

(52) U.S. Cl.

CPC ..... *C21D 8/1233* (2013.01); *C21D 8/1261* (2013.01); *C22C 38/001* (2013.01); *C22C 38/004* (2013.01); *C22C 38/008* (2013.01); *C22C 38/02* (2013.01); *C22C 38/04* (2013.01); *C22C 38/06* (2013.01); *C22C 38/14* (2013.01); *C22C 38/16* (2013.01); *C22C 38/42* (2013.01); *C22C 38/44* (2013.01); *C22C 38/46* (2013.01); *C22C 38/48* (2013.01); *C22C 38/50* (2013.01); *C22C 38/60* (2013.01)

(56) References Cited

FOREIGN PATENT DOCUMENTS

| | | | |
|---|---|---|---|
| EP | 3095887 | A1 | 11/2016 |
| JP | H07150248 | A | 6/1995 |
| JP | 2005-200713 | A | 7/2005 |
| JP | 2013-515166 | A | 5/2013 |
| KR | 10-0567239 | B1 | 4/2006 |
| KR | 10-2013-0076546 | A | 7/2013 |
| KR | 20130127295 | A | 11/2013 |
| KR | 10-2015-0015308 | A | 2/2015 |
| KR | 10-2015-0016434 | A | 2/2015 |
| KR | 10-2015-0016435 | A | 2/2015 |
| KR | 10-2015-0062246 | A | 6/2015 |
| KR | 10-2015-0062247 | A | 6/2015 |
| KR | 10-2015-0062250 | A | 6/2015 |
| KR | 10-2015-0125637 | A | 11/2015 |
| KR | 10-2015-0126331 | A | 11/2015 |
| WO | 2013/121924 | A1 | 8/2013 |
| WO | 2015-107967 | A1 | 7/2015 |

OTHER PUBLICATIONS

M. Kodym, et al. "Spurenelemente im Stahl—Moeglichkeiten zur Beeinflussung im Schmelzbetrieb", Spurenelemente in Staehlen, Verlag Stahleisen, Duesseldorf, DE, Jan. 1, 1985, pp. 19-22, XP002433212 & Its English Abstract, English translation of title: Trace elements in steel—possibilities for influencing the melting operation.

Japanese Office Action dated Jul. 30, 2019 issued in Japanese Patent Application No. 2018-533627.

Extended European Search Report dated Sep. 18, 2018 issued in European Patent Application No. 16879421.2.

International Search Report and Written Opinion issued in International Application No. PCT/KR2016/015233 dated Apr. 3, 2017.

* cited by examiner

| Element | AN | series | Net | [wt.%] | Error in wt.% (1 Sigma) |
|---|---|---|---|---|---|
| Nitrogen | 7 | K-series | 20043 | 56.26 | 0.42 |
| Aluminium | 13 | K-series | 56343 | 37.87 | 1.17 |
| Silicon | 14 | K-series | 7068 | 4.83 | 0.08 |
| Manganese | 25 | K-series | 693 | 0.65 | 0.06 |
| Sulfur | 16 | K-series | 541 | 0.38 | 0.05 |

NON-ORIENTED ELECTRICAL STEEL SHEET AND MANUFACTURING METHOD THEREFOR

CROSS REFERENCE

This application is the U.S. National Phase under 35 U.S.C. § 371 of International Application No. PCT/KR2016/015233 filed on Dec. 23, 2016, which claims the benefit of Korean Application No. 10-2015-0185428 filed on Dec. 23, 2015, the entire contents of each are hereby incorporated by reference.

TECHNICAL FIELD

A non-oriented electrical steel sheet and a manufacturing method thereof are disclosed.

BACKGROUND ART

Reducing impurities in a non-oriented electrical steel sheet is one of the most important technologies of reducing an electric power loss but has a problem of increasing a production cost and using a limited raw material. Specifically, an element like C, N, Ti, S, and the like in steel is bound to an element added to the steel for specific resistance, for example, Al, Mn, Cu, and the like and forms precipitates, which may work as fine precipitates preventing a movement of a magnetic wall during magnetization and particularly, has a negative influence on an iron loss at a high frequency wherein the movement of the magnetic wall occurs a lot. In addition, the fine precipitates prevents a crystal growth during the annealing and thus has a problem of increasing an annealing time during the cold-rolled sheet annealing, an annealing temperature up to extremely high, and the like to secure an appropriate crystal grain. Accordingly, technology of extremely reducing an addition amount of a corresponding element has been developed through selection of a raw material, least twice refining, and the like in a steel manufacture. However, in order to respond a sharp price rise of a steel raw material after 2000, an effort to reduce a production cost by using an inexpensive raw material to increase a steel production, shortening a steel manufacture process time, using an iron alloy highly including impurities to reduce a production cost, and the like has been made. On the other hand, as a high efficiency motor is mandatorily used all over the world to reduce energy consumption, development of an electrical steel sheet having a high magnetic flux density and a low iron loss and technology of manufacturing and using the same has been pursued. This technology development also has increased a need of development of an electrical steel sheet having excellent magnetism without controlling extremely low impurities.

In order to develop a non-oriented electrical steel sheet as a material used to convert electrical energy into kinetic energy, change a voltage, or perform other various energy conversions, various requirement characteristics are needed. Among these characteristics, particularly, low iron loss and high magnetic flux density characteristics at a frequency of electric power generated in each country power plant, low iron loss and high magnetic flux density characteristics at a high frequency for improving motor efficiency characteristics during the high speed rotation, workability characteristics for manufacturing a motor core, and the like are required. The workability indicates a burr generation or a distortion after a punching process, a damaging rate of a mold due to the electrical steel sheet, and the like. In general, a method of increasing specific resistance of steel is used in order to decrease an eddy-current loss due to an induced current generated during the magnetization of a steel sheet among losses generated in a motor, and when Si, Al, Mn, and the like is added to the steel, an element increasing the specific resistance of the steel is added thereto. Among these elements, Si is the most effective and thus included in a large amount in an electrical steel sheet, and accordingly, the electrical steel sheet has been called to be a silicon steel sheet (Si steel) for a long time. However, when Si, Al, and Mn are added to the steel, a ratio of Fe atoms working for magnetization is decreased in the steel having the same volume, and thus a magnetic flux density is deteriorated.

The magnetic flux density is determined by a Fe fraction in the steel and alignment of crystal grains of the steel, and the reason is magnetic anisotropy of the Fe atoms. Since the magnetic anisotropy makes a <100> axis of Fe monoatoms easily magnetized but a <110> axis, a <111> axis, and the like thereof hardly magnetized, when the atoms in the steel are aligned so that the <100> axis may be parallel to a magnetism direction, the steel has a high magnetic flux density at a low magnetic field. This principle is used to align an <100> axis of a {110} plane in a rolling direction to obtain an oriented electrical steel sheet. Since a non-oriented electrical steel sheet is mainly used for a motor having a rotating axis and thus has no consistent magnetization direction, an orientation of the <100> axis is difficult to determine, but since the non-oriented electrical steel sheet has a magnetization direction mainly in a sheet surface direction, a high magnetic flux density may be obtained in a low magnetic field by using a method of orienting the <100> axis helpful for magnetization on the sheet surface but not orienting an <112> axis or the <111> axis very difficult for magnetization.

When steel is magnetized, a magnetic domain in each crystal grain moves toward or rotates in a direction of an external magnetic field, wherein all sorts of precipitates prevent this movement of the magnetic domain. Accordingly, technology development of reducing an iron loss by strongly suppressing C, N, S, and the like forming precipitates has been made. However, in order to exclude impurities in the steel, a raw material should be pre-treated for a long time, or a high purity raw material should be used, and accordingly, there are various difficulties such as a manufacture cost increase and the like during the mass production. In addition, the precipitates are known to have a negative influence on workability as well as prevent recrystallization of the steel or suppress a crystal growth during annealing.

Herein, in order to prevent the precipitates formed by inevitably added impurities from being present as fine precipitates obstructing magnetization, a method of coarsening the precipitates by setting a slab reheating temperature at lower than or equal to a solid-solution temperature and thus preventing the precipitates from hindering movement of a magnetic wall is in general used to manufacture a non-oriented electrical steel sheet. Particularly, when the slab reheating temperature is higher than a re-solving temperature of the precipitates formed by C, N, S, and the like, the precipitates are extruded during the hot rolling and thus may have an influence on finish-annealing of the non-oriented electrical steel sheet and thus deteriorate a crystal grain growth during the annealing and also, hinder the movement of a magnetic wall and thus increasing an iron loss during the magnetization after the annealing as well as much deteriorate hot rolling property.

In general, when a segregation element such as Sn, Sb, P, and the like is added to a non-oriented electrical steel sheet and then, annealed at greater than or equal to 700° C., the segregation element is segregated on the grain boundary and has an effect of decreasing a crystal growth speed and thus may be used to control an initial recrystallization texture. However, since this effect of suppressing a crystal grain growth due to the segregation comes from a diffusion speed difference between each segregation element of Sn, Sb, and P and Fe atoms in a ferrite, and thus the diffusion speed difference between Fe atoms and atoms of the segregation elements is decreased in the annealing a high temperature for obtaining a large crystal grain to secure an excellent iron loss, the segregation effect becomes limited.

The ferrite including the non-oriented electrical steel sheet is known to produce a nucleus of a <100>||ND direction (a texture where a <100> direction is oriented within 15° from a perpendicular direction with the steel sheet surface) at the lowest temperature and form crystal grains aligned in a direction of <111>||ND, <112>||ND, and <100>||ND, as the annealing temperature is increased, when recrystallized through cold-rolling and then, annealing. Since the crystals grow after the nucleus is produced, another direction is first formed before inducing the crystal growth of the <100>||ND direction helpful for magnetism toward, and the crystal grains of the <100>||ND direction grow, and resultantly, the crystal grains of the <100>||ND direction have no chance of growing toward the <100>||ND direction but are inserted into crystal grains of the other directions and thus disappear in the steel. Accordingly, since the non-oriented electrical steel sheet has a tendency that a magnetic flux density decreases, as a crystal grain size is increased, there are technological difficulties of obtaining an iron loss reduction effect by increasing the crystal grain size and simultaneously, the high magnetic flux density. Accordingly, in order to technologically improving a fraction of crystal grains having the <100>||ND direction helpful for magnetism in the steel and reducing a fraction of crystal grains unhelpful for magnetism, a recrystallization temperature depending on each direction needs to be adjusted up to a high temperature where crystal grains having the <100>||ND direction are recrystallized and grow to maintain the recrystallized crystal grains having the <100>||ND direction.

DISCLOSURE

Technical Problem

An example embodiment of the present invention provides a non-oriented electrical steel sheet having improved magnetism by controlling contents of Al, Mn, Cu, Ti, N, and S of addition components of steel.

Another example embodiment of the present invention provides a method of manufacturing a non-oriented electrical steel sheet.

Technical Solution

A non-oriented electrical steel sheet according to an example embodiment of the present invention includes, by weight, 1.0% to 4.0% of Si, 0.001% to 0.01% of Al, 0.002% to 0.009% of S, 0.01% to 0.3% of Mn, 0.001% to 0.004% of N, 0.004% or less (0% exclusive) of C, 0.003% or less (0% exclusive) of Ti, Cu: 0.005% to 0.07%, 0.05% to 0.2% of either or both of Sn and P, and a balance amount of Fe and impurities.

Equation 1 may be satisfied.

$$\log\frac{([Mn]+[Cu])\times[S]}{([Al]+[Ti])\times[N]} \geq 0.85 \quad \text{[Equation 1]}$$

(In Equation 1, [Mn], [Cu], [S], [Al], [Ti], and [N] denote each content (wt %) of Mn, Cu, S, Al, Ti, and N.)

The number of an inclusion including N compositely with S is larger than the number of an inclusion including N alone of inclusions including N in the steel sheet.

At least one of Ni and Cr may be further included in an amount of 0.01 wt % to 0.1 wt % alone or as a mixture.

0.005 wt % to 0.06 wt % of Sb may be further included.

0.001 wt % to 0.015 wt % of Mo may be further included.

At least one of Bi, Pb, Mg, As, Nb and V may be further included in each amount of 0.0005 wt % to 0.005 wt %.

A Br value measured in a direction in which Br magnetic flux density is the highest on the sheet surface may be greater than or equal to 1.79 T, a Br value measured after 90° rotating relative to a perpendicular axis of the sheet surface in the direction may be greater than or equal to 1.72 T, and a Br value in a circumferential direction relative to a perpendicular axis of the sheet surface may be greater than or equal to 1.71 T.

(The Br is calculated by Equation 2.

$$Br = \frac{7.87}{(7.87 - 0.065\times[Si] - 0.1105\times[Al])}\times B50 \quad \text{[Equation 2]}$$

wherein in Equation 2, [Si] and [Al] denote each content (wt %) of Si and Al, and B50 denotes a strength (T) of a magnetic field induced when being placed at 5,000 A/m).

A hardness on the surface of the sheet measured using a Vickers hardness method may be 0.1 Hv to 10 Hv larger than a hardness of the cross-section of the sheet and the hardness of the surface may range from 130 Hv to 210 Hv.

A W15/100 (W/kg) value measured using an Epstein method divided by the square of the thickness (mm) of the sheet may be greater than or equal to 20 and less than or equal to 100.

(The W15/100 (W/kg) value refers to a loss generated when being excited at 1.5 T under a 100 Hz AC sinusoidal frequency condition.)

A Br value after annealing at 750° C. for 2 hours may be greater than or equal to 1.75 (T) and relative permeability (μ) at $B_{0.5}$ may be greater than or equal to 8000.

(wherein, $B_{0.5}$ is a strength of a magnetic field when being placed at 50 A/m and a relative permeability (μ) is $B_{0.5}/(50\times4\times\pi\times10^{-7})$.)

A volume fraction of a <100>||ND crystal grain may be greater than or equal to 15%, a volume fraction of a <100>||ND crystal grain may be greater than a volume fraction of a <111>||ND crystal grain, and an average crystal grain size may be smaller than the sheet thickness.

(<100>||ND means that a <100> axis of the crystal grain is within 15° from an axis (ND) perpendicular to an axis of the surface of the steel sheet and <111>||ND means that a <111> axis of the crystal grain is within 15° from an axis (ND) perpendicular to an axis of the surface of the steel sheet.)

A method of manufacturing the non-oriented electrical steel sheet according to an example embodiment of the present invention includes heating and hot-rolling a slab including by weight, 1.0% to 4.0% of Si, 0.001% to 0.01% of Al, 0.002% to 0.009% of S, 0.01% to 0.3% of Mn, 0.001% to 0.004% of N, 0.004% (0% exclusive) of C, 0.003% or less (0% exclusive) of Ti, 0.005% to 0.07% of Cu, 0.05% to 0.2% of either or both of Sn and P, and a balance amount of Fe and impurities, and satisfying Equation 1 to manufacture a hot-rolled sheet; annealing the hot-rolled sheet; cold-rolling the hot-rolled annealed sheet to manufacture a cold-rolled sheet; and finish-annealing the cold-rolled sheet.

The number of an inclusion including N compositely with S is larger than the number of an inclusion including N alone of inclusions including N in the steel sheet.

The slab may further include at least one of Ni and Cr in an amount of 0.01 wt % to 0.1 wt % alone or as a mixture.

The slab may further include 0.005 wt % to 0.06 wt % of Sb.

The slab may further include 0.001 wt % to 0.015 wt % of Mo.

The slab may further include at least one of Bi, Pb, Mg, As, Nb and V in each amount of 0.0005 wt % to 0.005 wt %.

The slab may be heated at 1,050° C. to 1,250° C.

An annealing temperature of the hot-rolled sheet may range from 950° C. to 1,150° C.

The cold-rolling may be performed to provide the cold-rolled sheet having a thickness of 0.36 mm or less.

A temperature of the finish-annealing may range from 750° C. to 1,050° C.

After the finish-annealing, the method may further include annealing the sheet at 700° C. to 900° C. for 1 to 10 hours.

Advantageous Effects

The non-oriented electrical steel sheet according to an example embodiment of the present invention has low iron loss and improved magnetic characteristics.

MODE FOR INVENTION

Figure 1:
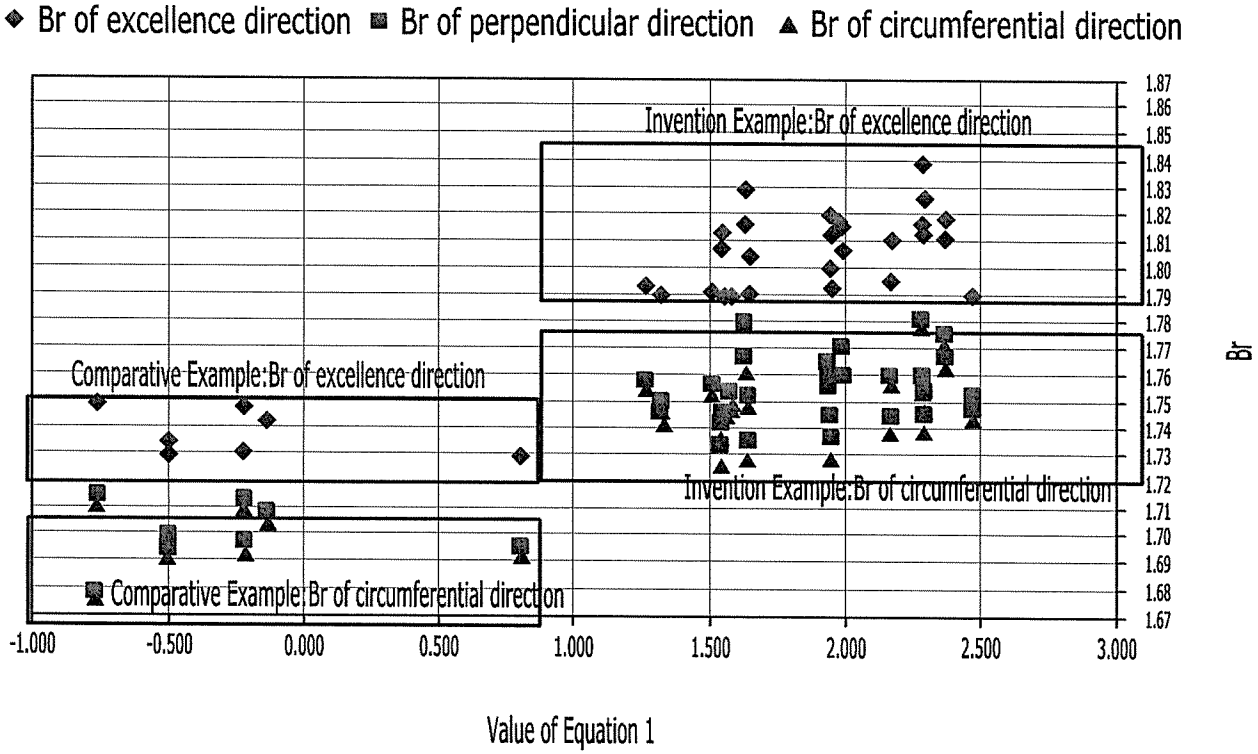
FIG. 1 is a graph showing values of magnetic flux density vs. values of Equation 1 measured in Example 1.

Although terms such as first, second, and third are used for describing various parts, various components, various areas, and/or various sections, the present invention is not limited thereto. Such terms are used only to distinguish any part, any component, any area, any layer, or any section from the other parts, the other components, the other areas, the other layers, or the other sections. Thus, a first part, a first component, a first area, a first layer, or a first section which is described below may be mentioned as a second part, a second component, a second area, a second layer, or a second section without departing from the scope of the present invention.

Here, terminologies used herein are merely used to describe a specific embodiment, and are not intended to limit the present invention. A singular form used herein includes a plural form as long as phrases do not express a clearly opposite meaning. The term "include" used in the specification specifies specific characteristics, a specific area, a specific essence, a specific step, a specific operation, a specific element, and/or a specific ingredient, and does not exclude existence or addition of the other characteristics, the other area, the other essence, the other step, the other operation, the other element, and/or the other ingredient.

When it is mentioned that a first component is located "above" or "on" a second component, the first component may be located directly "above" or "on" the second component or a third component may be interposed therebetween. In contrast, when it is mentioned that a first component is located "directly above" a second component, a third component is not interposed therebetween.

Although not otherwise defined, all terms used herein, including technical terms and scientific terms, have the same meanings as those generally understood by those skilled in the art to which the present invention pertains. Terms defined in a generally used dictionary are interpreted as meanings according with related technical documents and currently disclosed contents, and are not interpreted as ideal meanings or very formal meanings unless otherwise defined.

Further, unless otherwise defined, % refers to wt %, and 1 ppm means 0.0001 wt %.

Hereinafter, embodiments of the present disclosure will be described in detail such that those skilled in the art to which the present disclosure pertains may easily implement the embodiments. As those skilled in the art would realize, the described embodiments may be modified in various different ways, all without departing from the spirit or scope of the present invention.

A non-oriented electrical steel sheet according to an example embodiment of the present invention includes, by weight, 1.0% to 4.0% of Si, 0.001% to 0.01% of Al, 0.002% to 0.009% of S, 0.01% to 0.3% of Mn, 0.001% to 0.004% of N, 0.004% (0% exclusive) of C, 0.003% or less (0% exclusive) of Ti, 0.005% to 0.07% of Cu, 0.05% to 0.2% of either or both of Sn and P, and a balance amount of Fe and impurities.

First, the reason why the components of the non-oriented electric steel sheet are limited will be described.

Si: 1.0 wt % to 4.0 wt %

Silicon (Si) is an element playing a role of decreasing an eddy current loss out of an iron loss by increasing specific resistance in the steel and the most important alloy element in manufacturing the non-oriented electric steel sheet. In addition, the silicon (Si) plays a role of increasing a temperature where a ferrite phase is stably present in the steel and thus should be included in an amount of at least greater than or equal to 1.0 wt % in order to maintain the ferrite phase up to a temperature where the present invention may be effectively performed. Since each element forming precipitates in the steel is re-solved in a different amount in the ferrite phase and an austenite phase, the ferrite phase needs to be maintained at a high temperature. An upper limit of the amount of each element may be 4.0 wt % in order to secure cold-rolling property in a general industrial level but controlled to be less than or equal to 3.5 wt % to more stably secure the cold-rolling property.

Al: 0.001 wt % to 0.01 wt %

Aluminum (Al) in the steel plays a similar role of increasing specific resistance and the like to that of Si but is used as an element of forming nitride in the present invention, and accordingly, its amount is extremely limited compared with the amount of Si. A lower limit of the amount of Al should be at least greater than or equal to 0.001 wt %, so that AlN may be stably maintained up to a high temperature that a texture helpful for magnetism may be strongly formed during the anneal. When the upper limit thereof is greater than 0.01 wt %, fine precipitates are not formed but coarsened, and in addition, a temperature where the precipitates are present as a stable phase is extremely increased, and accordingly, the upper limit should be limited to be 0.01 wt %, since an effect of the fine precipitates may not be expected.

S: 0.002 wt % to 0.009 wt %

Sulfur (S) is bound to Mn and Cu or various metals in the steel and forms precipitates and thus is in general extremely limitedly used. However, the present invention is to limit an addition amount of each element as above in order to prevent the element from being coarsened and extracted as fine precipitates during the manufacture of a non-oriented electrical steel sheet and having an influence on magnetism of a final product. Particularly, the sulfur is a grain boundary segregation element and thus segregated on the grain boundary during the hot-rolled sheet annealing process, a main process of the present invention, and forms precipitates and thus leads to formation of a texture helpful for magnetism in the annealing process after the rolling and accordingly, needs to be included in an amount of at least greater than or equal to 0.002 wt %. However, when the sulfur is included in an amount of 0.009 wt %, precipitates may be coarsened before the hot-rolled sheet annealing process or remain as fine precipitates after the annealing following the cold-rolling and thus deteriorate an iron loss and the like, and accordingly, the upper limit thereof is limited to be 0.009 wt %.

Mn: 0.01 wt % to 0.3 wt %

Manganese (Mn) plays a similar role of increasing specific resistance in the steel and the like to that of Si but is bound to S and the like and forms precipitates, and accordingly, an addition amount thereof for improving magnetism of a non-oriented electrical steel sheet may be determined depending on that of S. In the present invention, the amount of manganese (Mn) needs to be at least greater than or equal to 0.01 wt %, so that MnS precipitates may sufficiently maintain a stable phase at a high temperature. In addition, when the amount of the manganese (Mn) is greater than 0.3 wt %, since sulfide may be coarsened before the hot-rolled sheet annealing process, the sulfur is all precipitated in the previous process in order not to be segregated in the hot-rolled sheet annealing process, or a ratio of an iron atom in the steel is decreased, magnetic flux density characteristics of an article after the finish-annealing, and accordingly, the upper limit is limited to be less than or equal to 0.3 wt %.

N: 0.001 wt % to 0.004 wt %

Nitrogen (N) is one of impurities inevitably present in the steel but bound to Al, Ti, and the like and forms precipitates and thus plays an important role in an effect of the invention, and the upper limit thereof needs to be 0.004 wt %, so that nitride already precipitated during a high temperature process may be completely or considerably dissolved. In addition, the nitrogen (N) needs to be included in an amount of greater than or equal to 0.001 wt % in order to be bound to Al and the like and form precipitates enough to form a recrystallization texture.

C: 0.004 wt % or less

Carbon (C) produces fine precipitates such as $Fe_3C$, NbC, TiC, ZrC, and the like and thus deteriorates magnetic characteristics and causes aging of magnetism and the like and accordingly, needs to be managed in a low level, but as a content of the carbon (C) is decreased, a refining cost is increased, and accordingly, the content of the carbon (C) is limited to be less than or equal to 0.004 wt %.

Ti: 0.003 wt % or Less

Titanium (Ti) is one of impurities inevitably present in the steel and in addition, has a high precipitation temperature and thus plays a role of suppressing an invention effect by reducing an amount of nitride such as AlN and the like, forming carbide such as TiC, and the like and increasing an iron loss but forms fine precipitates and thus help to control a recrystallization speed during the finish-annealing and accordingly, needs to be included in an amount of less than or equal to 0.003 wt %.

Sn, P: 0.05 wt % to 0.2 wt %

Tin (Sn) and phosphorus (P) are grain boundary segregation elements, and either one thereof is segregated during the hot-rolled sheet annealing and has a similarly remarkable effect on decreasing a recrystallization speed and a crystal grain growth speed during the annealing after the rolling and accordingly, needs to be included in an amount of at least greater than or equal to 0.05 wt %. However, when tin (Sn) and phosphorus (P) are included in a large amount, cold-rolling property is deteriorated, for example, a bonding force among crystal grains is deteriorated by a grain boundary segregation, and thus an addition amount thereof may be limited to be less than or equal to 0.2 wt %.

The Sn and P may be included alone or simultaneously together, and when included simultaneously together, their addition amount sum may be in a range of 0.05 wt % to 0.2 wt %.

Cu: 0.005 wt % to 0.07 wt %

Copper (Cu) has an effect of increasing specific resistance in the steel but is included in an amount of greater than or equal to 0.1 wt % mainly in a high strength non-oriented electrical steel sheet and the like to form fine precipitates in a large amount and thus increase strength and the like. In the present invention, the Cu precipitates have too high a precipitation temperature, causes fine precipitates, and suppresses a segregation effect of S necessary for an invention effect, and thus its upper limit should be 0.07 wt %. In addition, the copper may work as a nucleus for a MnS precipitation and thus should be included in an amount of at least greater than or equal to at least 0.005 wt % to form a texture helpful for magnetism.

Ni and Cr: 0.01 wt % to 0.1 wt %

Nickel (Ni) and chromium (Cr) may be inevitably included during the steel manufacturing process, but when Ni and Cr are further included, the Ni and Cr may be included alone or as a mixture within the above range.

Sb: 0.005 wt % to 0.06 wt %

Antimony (Sb) may be added as a grain boundary segregation element to suppress diffusion of nitrogen through the grain boundary, thus reduce a formation of {111} and {112} textures unhelpful for magnetism but increase {100} and {110} textures helpful for magnetism, and resultantly, improve magnetic characteristics.

Mo: 0.001% to 0.015%

When molybdenum (Mo) is included in an amount of greater than or equal to 0.001 wt % and thus segregated on the grain boundary, rolling properties are improved by increasing a bonding force among crystal grains, but when molybdenum (Mo) is included in a large amount, fine carbide is formed and thus increases an iron loss and the like, and thus its addition amount should be limited to be less than or equal to 0.015 wt %.

Bi, Pb, Mg, As, Nb, V: 0.0005 wt % to 0.005 wt %

When bismuth (Bi), lead (Pb), magnesium (Mg), arsenic (As), niobium (Nb), vanadium (V), and the like are present in a small amount in iron ores and thus remain in the steel after the steel manufacture or are permeated into a molten steel during the steel manufacture process, these elements form fine precipitates or are segregated on the grain boundary and thus play a role of decreasing a bonding force among crystal grains in the steel and thus smoothening an incision surface during the incision process such as punching and the like and reducing abrasion of a process equipment. In an example embodiment of the present invention, these elements may not be included, but when included in a range of at least greater than or equal to 0.0005 wt % and less than or equal to 0.005 wt %, the elements may effectively increase workability but suppress a negative influence on magnetism, and accordingly, the addition amount is limited within the range. Specifically, the range may be 0.0005 to 0.003 wt %.

The non-oriented electrical steel sheet according to an example embodiment of the present invention may satisfy Equation 1.

$$\log\frac{([Mn]+[Cu])\times[S]}{([Al]+[Ti])\times[N]} \geq 0.85 \quad \text{[Equation 1]}$$

(In Equation 1, [Mn], [Cu], [S], [Al], [Ti], and [N] denote each content (wt %) of Mn, Cu, S, Al, Ti, and N.)

When the steel manufactured by using components satisfying Equation 1 has sulfide and nitride as precipitates, the sulfide is mainly formed of an element of Mn and Cu, and the nitride is mainly formed of an element of Al and Ti, and herein, the sulfide should not be re-solved before the slab reheating after the steel manufacture but coarsened and continuously coarsened in the hot-rolled sheet annealing process and the finish-annealing process and have a negative influence on magnetism, since the nitride is respectively re-solved in a steel manufacture step, a slab reheating step when the slab is reheated, a hot-rolled sheet annealing step, and a finish-annealing step and then, repetitively reprecipitated in a cooling process from a high temperature to room temperature during the annealing process. When Equation 1 has a value of less than 0.85, since precipitates satisfying the invention effect are not controlled, for example, AlN is not re-solved at a high temperature, MnS is re-solved at the high temperature, or the like, each amount thereof is limited within the range. In addition, specifically, when Equation 1 has a value in a range of 1.5 to 2.5, the invention effect may be so remarkable that a non-oriented electrical steel sheet having excellent magnetic flux density and iron loss may be provided. Accordingly, each component is limited to satisfy the above composition equation.

In the non-oriented electrical steel sheet according to an example embodiment of the present invention, the number of an inclusion including N compositely with S is larger than the number of an inclusion including N alone (S in a base level). Since the number of an inclusion including N compositely with S is larger than the number of an inclusion including N alone, an iron loss may be reduced by decreasing hindrance and intervention against movement of a magnetic wall during magnetization. A carbon replica extracted from a specimen is examined with TEM and analyzed with EDS. Herein, the components of an inclusion are analyzed by measuring at least greater than or equal to 100 sheets of an image wherein an inclusion having a diameter of greater than or equal to 10 nm is clearly observed in a randomly selected area through an EDS spectrum analysis. Herein, the inclusion including N alone among the inclusions has a continuous shape in the TEM image and includes S in less than or equal to a base level through the EDS spectrum analysis, and the inclusion including N compositely with S is precipitates including S in a base level and in an amount of less than or equal to 1% in a part of the inclusion.

Figure 3:
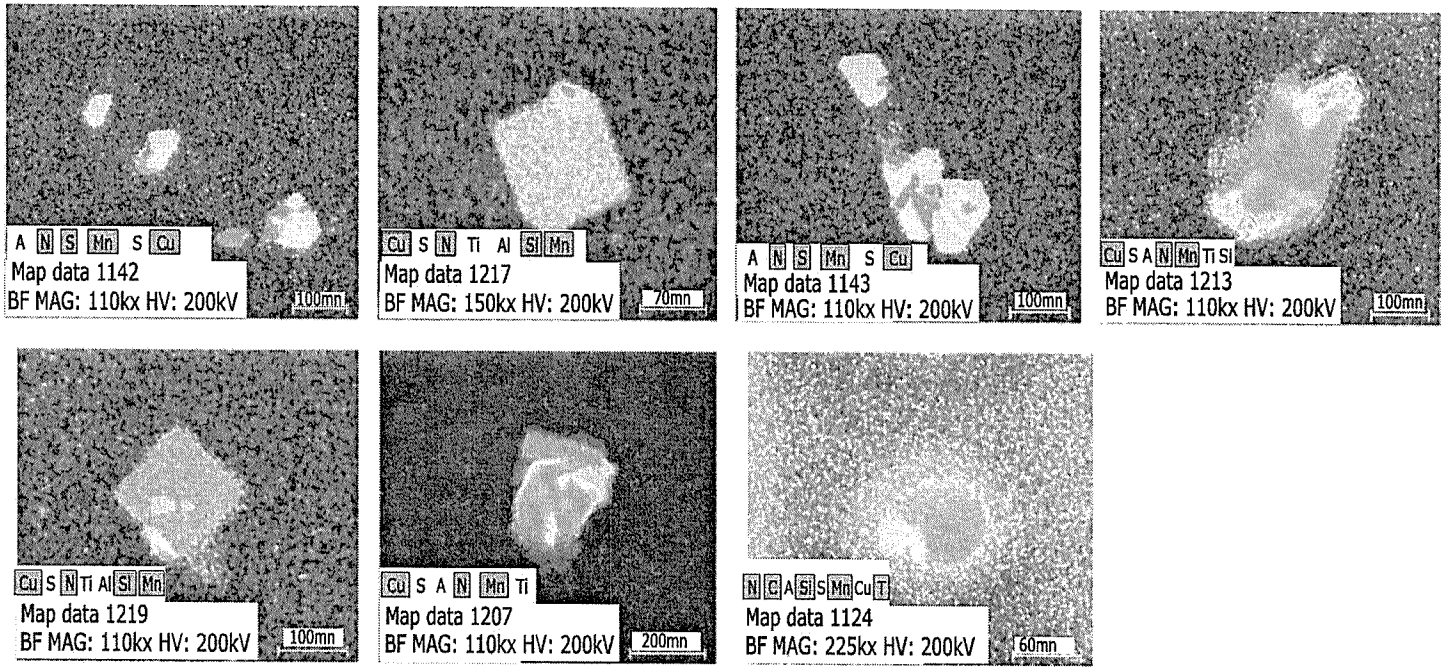
FIG. 3 is an inclusion including S and N compositely.
Figure 4:
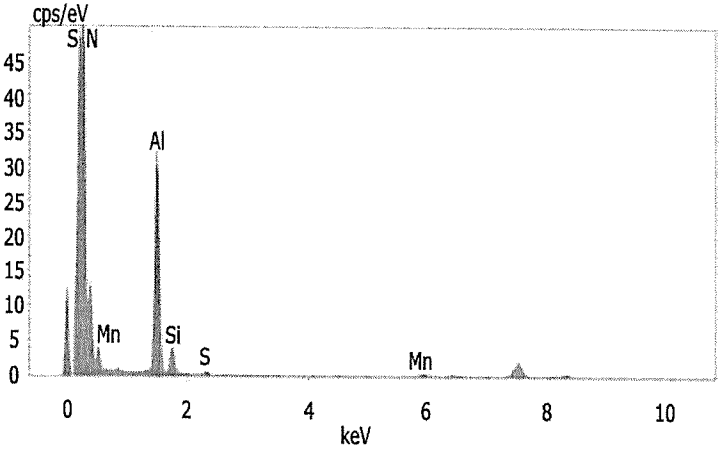
FIG. 4 is an inclusion including N alone.
Figure 4:
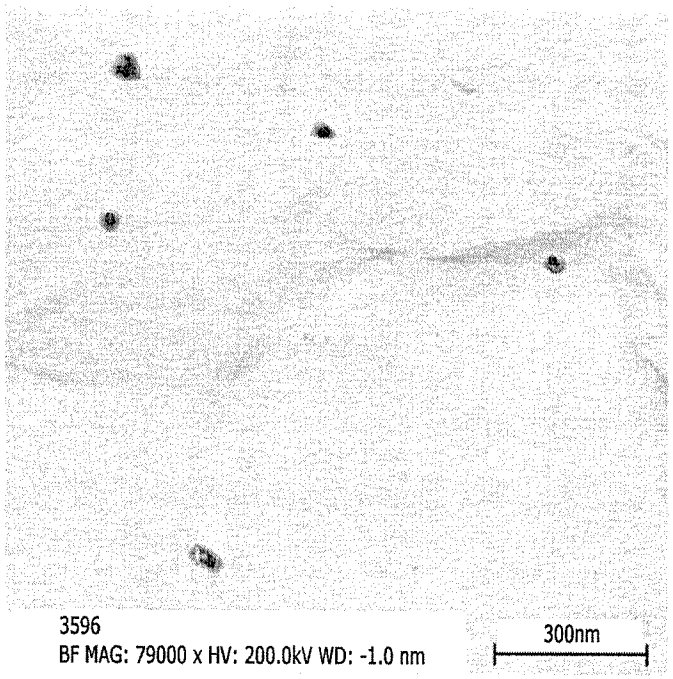

In FIG. 3, an inclusion including S and N compositely is shown. In FIG. 4, an inclusion including N alone is shown.

A magnetic flux density of the non-oriented electrical steel sheet according to an example embodiment of the present invention is calculated using a Br parameter. In general, a magnetic flux density is expressed without considering components in steel, but as for an electrical steel sheet, when a large amount of a nonmagnetic atom except for Fe is included in steel, a saturated magnetic flux density is deteriorated, and accordingly, the magnetic flux density is difficult to substantially evaluate by magnetism components in the steel. In general, a magnetic flux density of a non-oriented electrical steel sheet is expressed by measuring a magnetic flux density excited in a magnetic field of 5000 A/m with an Epstein standard test and expressing it as B50, and herein, B50 may be converted into Br, a parameter of the present invention, by using Equation 2.

$$Br = \frac{7.87}{(7.87 - 0.065\times[Si] - 0.1105\times[Al])}\times B50 \quad \text{[Equation 2]}$$

In Equation 2, [Si] and [Al] denote each content (wt %) of Si and Al, and B50 denotes a strength (T) of a magnetic field induced when being placed at 5,000 A/m.

This method may be used to equally compare a magnetic flux density of steel including Si and Al in a small amount and a magnetic flux density of steel including Si and Al in a large amount.

The non-oriented electrical steel sheet according to an example embodiment of the present invention has improved magnetic flux density and specifically a Br value measured in a direction in which magnetic flux density is the highest may be greater than or equal to 1.79 T, a Br value measured after 90° rotating relative to a perpendicular axis of the sheet surface in the direction may be greater than or equal to 1.72 T, and a Br value in a circumferential direction relative to a perpendicular axis of the sheet surface may be greater than or equal to 1.71 T.

The non-oriented electrical steel sheet is in general disposed after the punching process, and herein, since this punching is a process of cutting the sheet continuously moving at a high speed by using a mold, the mold may have a large abrasion difference depending on a use of an electrical steel sheet having excellent punching workability. Accordingly, the non-oriented electrical steel sheet pursues excellent magnetism and excellent workability in the mold. In the non-oriented electrical steel sheet according to an example embodiment of the present invention, a hardness on the surface of the sheet measured using a Vickers hardness method may be 0.1 Hv to 10 Hv larger than a hardness of the cross-section of the sheet and the hardness of the surface may range from 130 Hv to 210 Hv. Herein, when the hardness is less than 130 Hv, the sheet has so low hardness that Burr may be severely generated after the punching and so strong flexibility that it may not have a smooth incision surface, but when the hardness is greater than 210 Hv, a mold for incision may be so severely worn out and thus decrease the possible number of punch, while the Burr generation is suppressed, and thus workability of the electrical steel sheet may be deteriorated. In addition, when the sheet has a larger surface hardness in a range of 0.1 Hv to 10 Hv than a cross-sectional hardness of the sheet, the sheet has a smooth incision surface and a low Burr height and thus may maintain a precise shape after the deposition.

In the non-oriented electrical steel sheet according to an example embodiment of the present invention, a W15/100 (W/kg) value measured using a standard Epstein method divided by the square of the thickness (mm) of the sheet is limited to be greater than or equal to 20 and less than or equal to 100. In the non-oriented electrical steel sheet, an iron loss is reduced by reducing a thickness of the sheet, wherein characteristics that an eddy current loss induced into the sheet decreases in proportion to square of the thickness of the sheet are used. Accordingly, in order to linearly express an iron loss in a thin steel sheet, both the iron loss and the sheet thickness are preferably considered together. Herein, a W15/100 iron loss indicates an iron loss when the steel sheet is magnetized up to 1.5 T at SIN having a 100 Hz frequency. In order to obtain the W15/100 iron loss of less than or equal to 20, specific resistance should be increased, or a sheet should have an extremely thin thickness, and thus there is a problem of increasing a process cost, but when the W15/100 iron loss is greater than or equal to greater than or equal to 100, the iron loss may be increased. Specifically, a non-oriented electrical steel sheet having a W15/50 iron loss of less than or equal to 4.0 W/kg at a thickness of 0.5 mm, less than or equal to 2.6 W/kg at a thickness of 0.35 mm, less than or equal to 2.1 W/kg at a thickness of less than or equal to 0.3 mm, a W15/100 iron loss of less than or equal to 8.6 W/kg at a thickness of 0.5 mm, less than or equal to 5.5 W/kg at a thickness of 0.35 mm, and less than or equal to 5.0 W/kg at a thickness of less than or equal to 0.3 mm and thus an excellent iron loss is suggested.

In addition, a Br value after annealing at 750° C. for 2 hours may be greater than or equal to 1.75 (T) and relative permeability (μ) at $B_{0.5}$ may be greater than or equal to 8000. When a non-oriented electrical steel sheet may be manufactured through a stress-relief annealing (SRA), annealing at 700° C. to 900° C. for 1 hour to 10 hours after a punching process, and the like in order to make a motor and the like, there is a problem of growing crystal grains in the steel and thus deteriorating a texture and the like. In an example embodiment of the present invention, an electrical steel sheet having excellent magnetic flux density with Br of greater than or equal to 1.75 T before the annealing at 750° C. for 2 hours also has an excellent magnetic flux density of greater than or equal to 1.75 T after the SRA annealing. In addition, the non-oriented electrical steel sheet simultaneously may have greater than or equal to 8000 of very high relative permeability measured at 50 A/m. $B_{0.5}$ is a strength of a magnetic field when being placed at 50 A/m and a relative permeability (μ) is $B_{0.5}/(50\times4\times\pi\times10^{-7})$. π refers to a circular constant.

In the non-oriented electrical steel sheet according to an example embodiment of the present invention, a volume fraction of a <100>||ND crystal grain may be greater than or equal to 15%, a volume fraction of a <100>||ND crystal grain may be greater than a volume fraction of a <111>||ND crystal grain, and an average crystal grain size may be smaller than the sheet thickness.

Herein, <100>||ND means that a <110> axis of the crystal grain is within 15° from an axis (ND) perpendicular to an axis of the surface of the steel sheet and <111>||ND means that a <111> axis of the crystal grain is within 15° from an axis (ND) perpendicular to an axis of the surface of the steel sheet. The crystal grains of the ND||<100> direction may be easily magnetized, but crystal grains of the ND||<111> direction may hardly be magnetized. In an example embodiment of the present invention, the above crystal grains may be obtained by precisely adjusting each component range of a composition.

A method of manufacturing the non-oriented electrical steel sheet according to an example embodiment of the present invention includes heating and hot-rolling a slab including by weight, 1.0% to 4.0% of Si, 0.001% to 0.01% of Al, S: 0.003% to 0.009%, 0.01% to 0.3% of Mn, 0.001% to 0.004% of N, 0.004% (0% exclusive) of C, 0.003% or less (0% exclusive) of Ti, 0.05% to 0.2% of either or both of Sn and P, and a balance amount of Fe and impurities and satisfying Equation 1 to manufacture a hot-rolled sheet; annealing the hot-rolled sheet; cold-rolling the hot-rolled annealed sheet to manufacture a cold-rolled sheet; and finish-annealing the cold-rolled sheet.

First, the hot-rolled sheet is manufactured by heating the slab and then hot-rolling the slab. The reason why the addition ratios of the composition are limited is the same as the above-described reason why those of the non-oriented electric steel sheet are limited Since the composition of the slab is not substantially changed during the processes of hot-rolling, hot-rolled sheet annealing, cold-rolling, finish-annealing, and the like, which will be described later, the composition of the slab is substantially the same as the composition of the non-oriented electric steel sheet.

The slab is inserted into a heating furnace and is heated at 1,050° C. to 1,250° C.

The heated slab is hot rolled in a thickness of 1.4 mm to 3 mm and is manufactured into the hot-rolled sheet.

The hot-rolled sheet is annealed at a temperature of 850° C. to 1,150° C. to increase a crystal orientation helpful for magnetism. When the annealing temperature of the hot-rolled sheet is less than 850° C., a tissue is not grown or finely grown, and thus the magnetic flux density increases slightly, and when the annealing temperature of the hot-rolled sheet annealing temperature is greater than 1,150° C., magnetic characteristics may be deteriorated and rolling workability may deteriorate due to deformation of a sheet shape, and thus the temperature range is limited to 850° C. to 1,150° C. More specifically, an annealing temperature of the hot-rolled sheet may range from 950° C. to 1,150° C.

After pickling the annealed hot-rolled sheet, it is cold-rolled at a reduction ratio of 70% to 95% to have a predetermined plate thickness. Herein, an electrical steel sheet used for (hybrid vehicle)/EV (electric vehicle) may be cold-rolled into a thin plate having a thickness of less than or equal to 0.36 mm in order to reduce a high-frequency iron loss. When the thickness is greater than 0.36 mm, high frequency characteristics may not be improved as much as desired despite increasing specific resistance.

The cold-rolled plate after the cold-rolling is finish-annealed. The finish-annealing temperature may be 750° C. to 1,050° C. When the finish-annealing temperature is less than 750° C., recrystallization insufficiently occurs, and when the finish-annealing temperature is greater than 1,050° C., the crystal grain may be too large to increase high-frequency iron loss.

After the finish-annealing, the method may further include annealing the sheet at 700° C. to 900° C. for 1 to 10 hours. This process is referred to as stress-relief annealing (SRA) and the non-oriented electrical steel sheet according to an example embodiment of the present invention may maintain excellent magnetic flux density even after the SRA annealing process.

Hereinafter, the present invention is illustrated in more detail through Examples. However, the following Examples only exemplify the present invention but do not restrict the contents of the present invention.

Example 1

Each slab having a composition shown in Table 1 was heated at 1150° C., hot-rolled to have a thickness of 2.3 mm, and spiral-wound. Each hot-rolled steel sheet spiral-wound and cooled in the air was annealed at 1100° C. for 1 minute, cold-rolled to have a thickness of 0.35 mm, and each cold-rolled sheet was finish-annealed at 1020° C. for 100 seconds. Table 2 shows Br's of excellence magnetism direction and its perpendicular direction and circumferential direction and Invention Examples according to an invention condition in this kind of steel. In addition, FIG. 1 compares Br magnetic flux densities of Invention Examples and Comparative Examples according to a value of Equation 1.

TABLE 1

| Type of | Component (wt %) | | | | | | | | | | | | |
|---|---|---|---|---|---|---|---|---|---|---|---|---|---|
| steel | C | Mn | S | Ti | Sb | Sn | P | Si | Al | N | Cu | Ni | Cr |
| A0 | 0.0015 | 0.155 | 0.0060 | 0.0010 | 0.000 | 0.069 | 0.051 | 1.77 | 0.003 | 0.0013 | 0.012 | 0.011 | 0.014 |
| A1 | 0.0015 | 0.155 | 0.0060 | 0.0010 | 0.000 | 0.069 | 0.051 | 1.77 | 0.003 | 0.0013 | 0.014 | 0.011 | 0.014 |
| A2 | 0.0015 | 0.153 | 0.0070 | 0.0012 | 0.000 | 0.071 | 0.073 | 2.71 | 0.003 | 0.0014 | 0.007 | 0.011 | 0.016 |
| A3 | 0.0015 | 0.153 | 0.0070 | 0.0012 | 0.000 | 0.071 | 0.073 | 2.71 | 0.003 | 0.0014 | 0.013 | 0.011 | 0.016 |
| A4 | 0.0015 | 0.155 | 0.0060 | 0.0010 | 0.000 | 0.069 | 0.051 | 1.77 | 0.003 | 0.0013 | 0.07 | 0.011 | 0.014 |
| A5 | 0.002 | 0.155 | 0.0060 | 0.0010 | 0.000 | 0.069 | 0.051 | 1.770 | 0.003 | 0.0013 | 0.031 | 0.011 | 0.014 |
| A6 | 0.0015 | 0.188 | 0.0020 | 0.0020 | 0.000 | 0.023 | 0.006 | 3.15 | 0.790 | 0.0015 | 0 | 0 | 0 |
| A7 | 0.0015 | 0.283 | 0.0020 | 0.0020 | 0.000 | 0.000 | 0.011 | 2.95 | 0.510 | 0.0015 | 0 | 0 | 0 |
| A8 | 0.0015 | 0.228 | 0.0020 | 0.0020 | 0.000 | 0.000 | 0.012 | 2.63 | 0.500 | 0.0015 | 0 | 0 | 0 |
| A9 | 0.0015 | 0.188 | 0.0020 | 0.0020 | 0.000 | 0.023 | 0.006 | 3.15 | 0.790 | 0.0015 | 0 | 0 | 0 |
| A10 | 0.0015 | 0.030 | 0.0020 | 0.0020 | 0.000 | 0.028 | 0.056 | 2.92 | 0.232 | 0.0015 | 0 | 0 | 0 |
| A11 | 0.0015 | 0.228 | 0.0020 | 0.0020 | 0.000 | 0.000 | 0.012 | 2.63 | 0.500 | 0.0015 | 0 | 0 | 0 |
| A12 | 0.0010 | 0.502 | 0.0020 | 0.0014 | 0.012 | 0.074 | 0.042 | 4.05 | 0.104 | 0.0015 | 0 | 0 | 0 |
| A13 | 0.0025 | 0.044 | 0.0016 | 0.0013 | 0.010 | 0.029 | 0.045 | 3.03 | 0.290 | 0.0014 | 0 | 0 | 0 |

TABLE 2

| Type of steel | Value of Equation 1 | Br of excellence direction, T | Br of perpendicular direction, T | Br of circumferential direction, T | Note |
|---|---|---|---|---|---|
| A0 | 2.282 | 1.84 | 1.76 | 1.75 | Invention Example |
| A1 | 2.282 | 1.84 | 1.76 | 1.75 | Invention Example |
| A2 | 2.291 | 1.81 | 1.74 | 1.74 | Invention Example |
| A3 | 2.291 | 1.81 | 1.74 | 1.74 | Invention Example |
| A4 | 2.282 | 1.82 | 1.78 | 1.78 | Invention Example |
| A5 | 2.282 | 1.84 | 1.76 | 1.75 | Invention Example |
| A6 | −0.500 | 1.73 | 1.70 | 1.70 | Comparative Example |
| A7 | −0.133 | 1.74 | 1.71 | 1.70 | Comparative Example |
| A8 | −0.218 | 1.75 | 1.71 | 1.71 | Comparative Example |
| A9 | −0.500 | 1.73 | 1.69 | 1.69 | Comparative Example |
| A10 | −0.767 | 1.71 | 1.68 | 1.68 | Comparative Example |
| A11 | −0.218 | 1.73 | 1.70 | 1.69 | Comparative Example |
| A12 | 0.803 | 1.73 | 1.69 | 1.69 | Comparative Example |
| A13 | −0.763 | 1.75 | 1.71 | 1.71 | Comparative Example |

As shown in Tables 1 and 2, various compositions satisfying a condition of the present invention showed very excellent Br magnetic flux density characteristics in various directions.

FIG. 1 shows a magnetic flux density according to a value of Equation 1 based on Tables 1 and 2.

Example 2

Each slab having each composition shown in Tables 3 and 4 was heated at 1130° C., hot-rolled to have a thickness of 2.3 mm, and spiral-wound. Each hot-rolled steel sheet spiral-wound and cooled down in the air was annealed at 1120° C. for 1 minute, pickled and cold-rolled to have a thickness of 0.35 mm, and then, finish-annealed at 1050° C. for 100 seconds. Hardness of each finish-annealed steel sheet was measured in a Vickers hardness method, and the results are shown in Table 4.

TABLE 3

| Type of steel | C | Mn | S | Ti | Sb | Sn | P | Si | Al | N | Cu | Ni | Cr |
|---|---|---|---|---|---|---|---|---|---|---|---|---|---|
| B1 | <0.003 | 0.155 | 0.006 | 0.001 | 0 | 0.069 | 0.051 | 1.77 | 0.003 | 0.0013 | 0.011 | 0.011 | 0.014 |
| B2 | <0.003 | 0.152 | 0.005 | 0.001 | 0 | 0.07 | 0.052 | 1.79 | 0.003 | 0.0014 | 0.01 | 0.075 | 0.017 |
| B3 | <0.003 | 0.049 | 0.006 | 0.0009 | 0.057 | 0.065 | 0 | 2.46 | 0.003 | 0.0012 | 0.011 | 0.01 | 0.018 |
| B4 | <0.003 | 0.021 | 0.005 | 0.0008 | 0 | 0.062 | 0.067 | 2.43 | 0.003 | 0.0016 | 0.011 | 0.011 | 0.015 |
| B5 | <0.003 | 0.153 | 0.007 | 0.0012 | 0 | 0.068 | 0.046 | 2.69 | 0.004 | 0.0017 | 0.012 | 0.012 | 0.016 |
| B6 | <0.003 | 0.165 | 0.006 | 0.0011 | 0 | 0.071 | 0.054 | 2.71 | 0.003 | 0.0014 | 0.011 | 0.082 | 0.015 |
| B7 | <0.003 | 0.153 | 0.007 | 0.0012 | 0 | 0.071 | 0.073 | 2.71 | 0.003 | 0.0014 | 0.011 | 0.011 | 0.016 |
| B8 | <0.003 | 0.154 | 0.006 | 0.001 | 0 | 0.07 | 0.076 | 2.78 | 0.003 | 0.0016 | 0.012 | 0.082 | 0.015 |
| B9 | <0.003 | 0.252 | 0.006 | 0.0015 | 0 | 0.068 | 0.053 | 3.01 | 0.006 | 0.0013 | 0.012 | 0.011 | 0.012 |
| B10 | <0.003 | 0.063 | 0.005 | 0.0011 | 0 | 0.074 | 0.046 | 3.08 | 0.006 | 0.0014 | 0.01 | 0.01 | 0.012 |
| B11 | <0.003 | 0.152 | 0.005 | 0.001 | 0.033 | 0.073 | 0.01 | 3.34 | 0.004 | 0.0012 | 0.01 | 0.01 | 0.011 |
| B12 | <0.003 | 0.158 | 0.005 | 0.001 | 0 | 0.07 | 0.05 | 3.27 | 0.005 | 0.0013 | 0.011 | 0.009 | 0.011 |
| B13 | <0.003 | 0.061 | 0.006 | 0.001 | 0 | 0.065 | 0.054 | 3.33 | 0.006 | 0.0013 | 0.009 | 0.009 | 0.012 |
| B14 | <0.003 | 0.0154 | 0.006 | 0.001 | 0 | 0.069 | 0.05 | 1.79 | 0.007 | 0.0013 | 0.011 | 0.011 | 0.014 |
| B15 | <0.003 | 0.0158 | 0.007 | 0.0012 | 0 | 0.07 | 0.075 | 2.75 | 0.004 | 0.0014 | 0.011 | 0.011 | 0.016 |
| B16 | <0.003 | 0.016 | 0.006 | 0.0011 | 0 | 0.075 | 0.055 | 2.70 | 0.003 | 0.0014 | 0.011 | 0.082 | 0.015 |
| B17 | <0.003 | 0.05 | 0.006 | 0.0009 | 0.057 | 0.062 | 0 | 2.46 | 0.0025 | 0.0012 | 0.011 | 0.01 | 0.018 |
| B18 | <0.003 | 0.065 | 0.005 | 0.0011 | 0 | 0.072 | 0.043 | 3.08 | 0.006 | 0.0014 | 0.01 | 0.01 | 0.012 |
| B19 | <0.003 | 0.016 | 0.005 | 0.001 | 0 | 0.07 | 0.05 | 3.27 | 0.005 | 0.0013 | 0.011 | 0.009 | 0.011 |
| B20 | <0.003 | 0.2 | 0.005 | 0.0015 | 0 | 0.05 | 0.05 | 3.01 | 0.005 | 0.0016 | 0.008 | 0.12 | 0.015 |

TABLE 4

| Type of steel | Mo | Bi | Pb | Mg | As | Nb | V | Value of Equation 1 | Br excellence direction | Br perpendicular direction | Br circumferential direction | Vickers hardness of sheet surface, HV | Vickers hardness of sheet cross-section, HV |
|---|---|---|---|---|---|---|---|---|---|---|---|---|---|
| B1 | 0 | 0.0005 | <0.005 | <0.005 | <0.005 | <0.005 | <0.005 | 2.28 | 1.84 | 1.76 | 1.75 | 152 | 150 |
| B2 | 0.002 | <0.005 | 0.0006 | <0.005 | <0.005 | <0.005 | <0.005 | 2.16 | 1.83 | 1.76 | 1.76 | 153 | 152 |
| B3 | 0 | 0.001 | 0.0005 | <0.005 | <0.005 | <0.005 | <0.005 | 1.89 | 1.81 | 1.73 | 1.72 | 166 | 160 |
| B4 | 0 | <0.005 | <0.005 | 0.001 | <0.005 | <0.005 | <0.005 | 1.42 | 1.82 | 1.74 | 1.73 | 179 | 175 |
| B5 | 0 | <0.005 | <0.005 | <0.005 | 0.001 | <0.005 | <0.005 | 2.12 | 1.81 | 1.74 | 1.73 | 183 | 181 |
| B6 | 0 | <0.005 | <0.005 | <0.005 | 0.0006 | <0.005 | <0.005 | 2.26 | 1.81 | 1.74 | 1.74 | 186 | 183 |
| B7 | 0.01 | <0.005 | <0.005 | <0.005 | <0.005 | 0.001 | <0.005 | 2.29 | 1.81 | 1.74 | 1.74 | 190 | 185 |
| B8 | 0 | <0.005 | <0.005 | <0.005 | <0.005 | <0.005 | 0.002 | 2.19 | 1.81 | 1.75 | 1.74 | 193 | 190 |
| B9 | 0 | <0.005 | 0.001 | 0.0006 | <0.005 | <0.005 | <0.005 | 2.21 | 1.80 | 1.73 | 1.73 | 196 | 191 |
| B10 | 0 | 0.001 | <0.005 | 0.001 | <0.005 | <0.005 | 0.001 | 1.56 | 1.81 | 1.73 | 1.72 | 197 | 189 |
| B11 | 0.001 | <0.005 | 0.001 | 0.0005 | 0.001 | 0.001 | 0.002 | 2.13 | 1.79 | 1.72 | 1.71 | 199 | 195 |
| B12 | 0 | <0.005 | <0.005 | <0.005 | <0.005 | <0.005 | <0.005 | 2.03 | 1.80 | 1.72 | 1.72 | 205 | 200 |
| B13 | 0.001 | <0.005 | <0.005 | <0.005 | <0.005 | 0.005 | <0.005 | 1.66 | 1.80 | 1.73 | 1.72 | 207 | 206 |
| B14 | <0.005 | <0.005 | <0.005 | <0.005 | 0.006 | <0.005 | <0.005 | 1.18 | 1.82 | 1.73 | 1.73 | 164 | 153 |
| B15 | 0.002 | <0.005 | <0.005 | 0.005 | <0.005 | <0.005 | <0.005 | 1.41 | 1.79 | 1.72 | 1.72 | 205 | 191 |
| B16 | <0.005 | <0.005 | 0.005 | <0.005 | <0.005 | <0.005 | <0.005 | 1.45 | 1.80 | 1.73 | 1.72 | 200 | 186 |
| B17 | <0.005 | 0.01 | <0.005 | <0.005 | <0.005 | <0.005 | <0.005 | 1.95 | 1.79 | 1.72 | 1.71 | 195 | 166 |
| B18 | <0.005 | 0.01 | 0.01 | <0.005 | <0.005 | <0.005 | <0.005 | 1.58 | 1.82 | 1.74 | 1.73 | 195 | 197 |
| B19 | <0.005 | <0.005 | 0.01 | 0.01 | <0.005 | <0.005 | <0.005 | 1.24 | 1.79 | 1.74 | 1.73 | 221 | 205 |
| B20 | <0.005 | <0.005 | <0.005 | <0.005 | 0.01 | 0.01 | <0.005 | 2.00 | 1.81 | 1.73 | 1.72 | 206 | 195 |

As shown in Table 4, all the types of steels showed excellent Br's of excellence magnetism direction and its perpendicular direction and circumferential direction. In addition, when Mo, Bi, Pb, Mg, As, Nb, and V do not satisfy particular ranges, Vickers hardness in a sheet surface and hardness in a sheet cross-section may not have a difference in a range of 0.1 Hv to 10 Hv.

Example 3

Each slab having a composition shown in Table 5 was heated at 1150° C., hot-rolled to have a thickness of 2.3 mm, and spiral-wound. Each hot-rolled steel sheet spiral-wound and cooled down in the air was annealed at 1120° C. for 1 minute, pickled and cold-rolled to have a thickness of 0.25 mm, and then, finish-annealed at 1050° C. for 60 seconds. Table 6 shows W15/50, W15/100 iron loss, Br, and relative permeability at B0.5 after the annealing at 750° C. for 2 hours.

TABLE 5

| No | C | Mn | S | Ti | Sb | Sn | P | Si | Al | N | Cu |
|---|---|---|---|---|---|---|---|---|---|---|---|
| C1 | 0.0015 | 0.252 | 0.006 | 0.0015 | 0 | 0.068 | 0.053 | 3.01 | 0.006 | 0.0013 | 0.012 |
| C2 | 0.0015 | 0.063 | 0.005 | 0.0011 | 0 | 0.074 | 0.046 | 3.08 | 0.006 | 0.0014 | 0.01 |
| C3 | 0.0015 | 0.061 | 0.006 | 0.001 | 0 | 0.065 | 0.054 | 3.33 | 0.006 | 0.0013 | 0.009 |
| C4 | 0.0015 | 0.158 | 0.005 | 0.001 | 0 | 0.07 | 0.05 | 3.27 | 0.005 | 0.0013 | 0.011 |
| C5 | 0.0015 | 0.158 | 0.0012 | 0.001 | 0 | 0.05 | 0.03 | 3.2 | 0.5 | 0.0015 | 0.01 |

TABLE 6

| | | After continuous annealing and before annealing at 750° C. | | | | | After annealing at 750° C. for 2 hours | | | | | |
|---|---|---|---|---|---|---|---|---|---|---|---|---|
| No | Value of Equation 1 | W15/50 | Br | B0.5 relative permeability | W15/100 | W15/100/ thickness$^2$ | W15/50 | Br | B0.5 relative permeability | W15/100 | W15/100/ thickness$^2$ | |
| C1 | 2.211 | 2.05 | 1.76 | 10231 | 4.51 | 72.16 | 1.92 | 1.76 | 11452 | 4.35 | 69.6 | Invention Example |
| C2 | 1.565 | 2.06 | 1.76 | 9534 | 4.93 | 78.88 | 2.08 | 1.76 | 10809 | 4.85 | 77.6 | Invention Example |
| C3 | 1.664 | 2.13 | 1.76 | 7551 | 4.85 | 77.60 | 2.05 | 1.76 | 9437 | 4.72 | 75.52 | Invention Example |
| C4 | 2.035 | 2.03 | 1.76 | 8512 | 4.61 | 73.76 | 1.94 | 1.75 | 9678 | 4.51 | 72.16 | Invention Example |
| C5 | −0.571 | 1.90 | 1.73 | 6523 | 4.90 | 78.40 | 1.84 | 1.72 | 9500 | 4.60 | 73.6 | Comparative Example |

As shown in Table 6, an iron loss and a magnetic flux density turned out to be high before and after the SRA annealing.

Example 4

Each slab having a composition shown in Table 7 was heated at 1130° C., hot-rolled to have a thickness of 2.3 mm, and then, spiral-wound. Each hot-rolled steel sheet spiral-wound and cooled down in the air was annealed at 1120° C. for 1 minute, pickled and cold-rolled to have each thickness of 0.5 mm, 0.35 mm, 0.30 mm, 0.27 mm, 0.25 mm, and 0.2 mm, and then, finish-annealed at 1050° C. for 50 seconds, and then, its magnetism was measured. Carbon replicas extracted from specimens were examined with TEM and analyzed with EDS. Herein, at least 100 images in which an inclusion having a diameter of greater than or equal to 10 nm is clearly observed were measured to component-analyze the inclusion through an EDS spectrum analysis. Herein, an inclusion including N alone among the inclusions indicates that S is found in an amount of less than or equal to a base level in a TEM image showing a continuous shape of the inclusion, and an inclusion compositely including with S indicates precipitates including S in an amount of a base level and less than or equal to 1% in a part of the inclusion showing a continuous shape.

TABLE 7

| Type of steel | Thickness | C | Mn | S | Ti | Sn | P | Si | Al | N | Cu |
|---|---|---|---|---|---|---|---|---|---|---|---|
| D1 | 0.5 | 0.001 | 0.158 | 0.005 | 0.0014 | 0.068 | 0.042 | 2.970 | 0.003 | 0.0014 | 0.006 |
| D2 | 0.35 | 0.001 | 0.158 | 0.005 | 0.0014 | 0.068 | 0.042 | 2.970 | 0.003 | 0.0014 | 0.006 |
| D3 | 0.3 | 0.001 | 0.158 | 0.005 | 0.0014 | 0.068 | 0.042 | 2.970 | 0.003 | 0.0014 | 0.006 |
| D4 | 0.27 | 0.001 | 0.158 | 0.005 | 0.0014 | 0.068 | 0.042 | 2.970 | 0.003 | 0.0014 | 0.006 |
| D5 | 0.25 | 0.001 | 0.158 | 0.005 | 0.0014 | 0.068 | 0.042 | 2.970 | 0.003 | 0.0014 | 0.006 |
| D6 | 0.2 | 0.001 | 0.158 | 0.005 | 0.0014 | 0.068 | 0.042 | 2.970 | 0.003 | 0.0014 | 0.006 |
| D7 | 0.5 | 0.001 | 0.400 | 0.002 | 0.0018 | 0.030 | 0.030 | 1.300 | 0.500 | 0.0020 | 0.006 |

TABLE 8

| Value of Equation 1 | W15/50 | W15/100 | W15/100/ thickness$^2$ | Br | Composite inclusion/ inclusion including N alone | Note |
|---|---|---|---|---|---|---|
| 2.12 | 2.48 | 8.50 | 34 | 1.789 | 8.0 | Invention Example |
| 2.12 | 2.08 | 5.15 | 42 | 1.785 | 8.0 | Invention Example |
| 2.12 | 2.03 | 4.88 | 54 | 1.780 | 8.0 | Invention Example |
| 2.12 | 2.02 | 4.75 | 65 | 1.772 | 8.0 | Invention Example |
| 2.12 | 2.00 | 4.52 | 72 | 1.767 | 8.0 | Invention Example |
| 2.12 | 1.89 | 4.10 | 103 | 1.767 | 8.0 | Invention Example |
| −0.09 | 3.20 | 12.60 | 103 | 1.730 | 0.0 | Comparative Example |

As shown in Table 8, an iron loss and a magnetic flux density turned out to be high before and after the SRA annealing.

Example 5

Each slab having a composition shown in Table 9 was heated at 1130° C., hot-rolled to have a thickness of 2.5 mm, and spiral-wound. Each hot-rolled steel sheet spiral-wound and cooled down in the air was annealed at 1130° C. for 1 minute, pickled and cold-rolled to have a thickness of 0.35 mm, and finish-annealed at 1050° C. for 60 second to prepare electrical steel sheets. Fractions of crystal grains were analyzed by using a measurement result an area of at least greater than or equal to 10 mm×10 mm in any side having ⅛ to ½ of a thickness of a sheet through EBSD.

TABLE 9

| C | Mn | S | Ti | Sb | Sn | P | Si | Al | N | Cu |
|---|---|---|---|---|---|---|---|---|---|---|
| 0.0014 | 0.15 | 0.005 | 0.0012 | 0 | 0.1 | 0.05 | 2.5 | 0.002 | 0.0012 | 0.01 |
| 0.0014 | 0.15 | 0.005 | 0.0012 | 0 | 0.1 | 0.05 | 2.5 | 0.003 | 0.0012 | 0.005 |
| 0.0024 | 0.054 | 0.0055 | 0.001 | 0 | 0.045 | 0.0504 | 2.424 | 0.0046 | 0.0015 | 0.005 |
| 0.002 | 0.15 | 0.004 | 0.0009 | 0 | 0.048 | 0.037 | 2.2 | 0.002 | 0.0017 | 0.006 |
| 0.0014 | 0.15 | 0.005 | 0.0012 | 0 | 0.07 | 0.08 | 2.5 | 0.003 | 0.0012 | 0.007 |
| 0.002 | 0.3 | 0.0015 | 0.002 | 0.03 | 0.03 | 0.02 | 2.5 | 0.3 | 0.002 | 0.01 |

Table 10 of the present specification

TABLE 10

| Value of Equation 1 | Br of excellence direction | Br of perpendicular direction | Br of circumferential direction | <100> \|\| ND fraction within 15° | <111> \|\| ND fraction within 15° | Note |
|---|---|---|---|---|---|---|
| 2.319 | 1.826 | 1.769 | 1.764 | 0.2674 | 0.0909 | Invention Example |
| 2.187 | 1.824 | 1.771 | 1.766 | 0.1958 | 0.1444 | Invention Example |
| 1.587 | 1.813 | 1.747 | 1.741 | 0.1958 | 0.1797 | Invention Example |
| 2.102 | 1.832 | 1.756 | 1.750 | 0.1604 | 0.1402 | Invention Example |
| 2.192 | 1.819 | 1.759 | 1.754 | 0.2598 | 0.0896 | Invention Example |
| −0.114 | 1.750 | 1.712 | 1.702 | 0.1350 | 0.2150 | Comparative Example |

As shown in Table 10, in Examples satisfying greater than or equal to 0.85 of a value of Equation 1, a fraction of crystal grains having an orientation of ND||<100> was larger than a fraction of crystal grains having an orientation of ND||<111>, and particularly, when the value of Equation 1 is greater than or equal to 1.5, a ratio of ND||<100>/ND||<111> increased, as Log(([Mn+Cu]*[S])/[Al+Ti]*[N])) increased.

Figure 2:
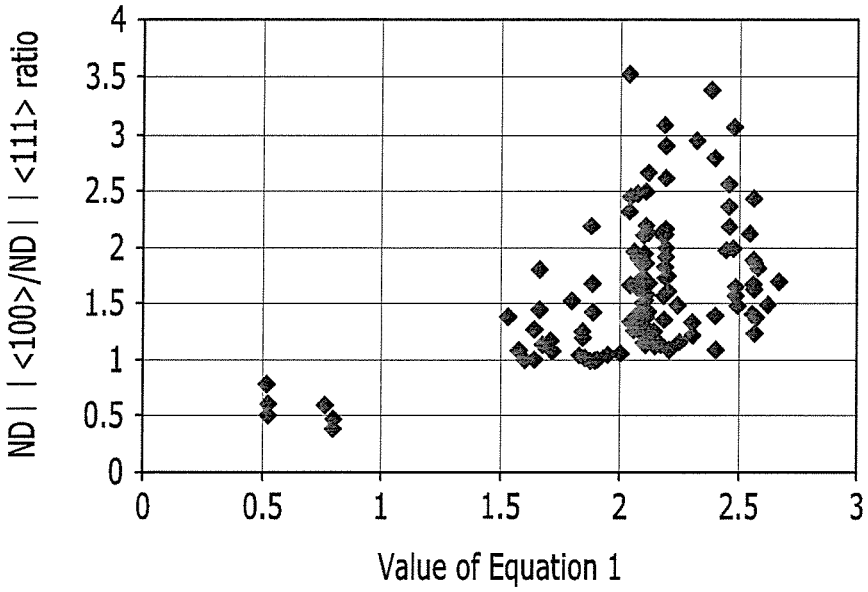
FIG. 2 is a graph showing texture ratios vs. values of Equation 1 measured in Example 5.

FIG. 2 shows a texture ratio depending on a value of Equation 1 by summarizing Table 10.

While this invention has been described in connection with what is presently considered to be practical example embodiments, it is to be understood that the invention is not limited to the disclosed embodiments, but, on the contrary, is intended to cover various modifications and equivalent arrangements included within the spirit and scope of the appended claims. Therefore, the aforementioned embodiments should be understood to be exemplary but not limiting the present invention in any way.

The invention claimed is:

1. A non-oriented electrical steel sheet, comprising by weight, 1.0% to 4.0% of Si, 0.001% to 0.01% of Al, 0.002% to 0.009% of S, 0.01% to 0.3% of Mn, 0.001% to 0.004% of N, 0.004% or less and 0% exclusive of C, 0.003% or less and 0% exclusive of Ti, 0.005% to 0.07% of Cu, 0.05% to 0.2% of either or both of Sn and P, and a balance amount of Fe and impurities, and satisfying [Equation 1], wherein a number of an inclusion of N compositely with S is larger than a number of an inclusion of N alone in the steel sheet, $$\log\frac{([Mn]+[Cu])\times[S]}{([Al]+[Ti])\times[N]} \geq 0.85 \qquad \text{[Equation 1]}$$

in [Equation 1], [Mn], [Cu], [S], [Al], [Ti], and [N] denote each content wt % of Mn, Cu, S, Al, Ti, and N, wherein a volume fraction of a <100>||ND crystal grain is greater than or equal to 15%, a volume fraction of a <100>||ND crystal grain is greater than a volume fraction of a <111>||ND crystal grain, and an average crystal grain size is smaller than the sheet thickness, wherein <100>||ND means that a <100> axis of the crystal grain is within 15° from an axis (ND) perpendicular to an axis of the surface of the steel sheet and <111>||ND means that a <111> axis of the crystal grain is within 15° from an axis (ND) perpendicular to an axis of the surface of the steel sheet.

2. The non-oriented electrical steel sheet of claim 1, wherein at least one of Ni and Cr is further included in an amount of 0.01 wt % to 0.1 wt % alone or as a mixture.

3. The non-oriented electrical steel sheet of claim 1, wherein 0.005 wt % to 0.06 wt % of Sb is further included.

4. The non-oriented electrical steel sheet of claim 1, wherein 0.001 wt % to 0.015 wt % of Mo is further included.

5. The non-oriented electrical steel sheet of claim 1, wherein at least one of Bi, Pb, Mg, As, Nb and V is further included in each amount of 0.0005 wt % to 0.005 wt %.

6. The non-oriented electrical steel sheet of claim 1, wherein Br value measured in a direction in which Br magnetic flux density is the highest on the sheet surface is greater than or equal to 1.79 T, a Br value measured after 90° rotating relative to a perpendicular axis of the sheet surface in the direction is greater than or equal to 1.72 T, and a Br value in a circumferential direction relative to a perpendicular axis of the sheet surface is greater than or equal to 1.71 T the Br is calculated by [Equation 2]:

$$Br = \frac{7.87}{(7.87 - 0.065 \times [Si] - 0.1105 \times [Al])} \times B50$$

wherein, in [Equation 2], [Si] and [Al] denote each wt % content of Si and Al, and B50 denotes a strength (T) of a magnetic field induced when being placed at 5,000 A/m.

7. The non-oriented electrical steel sheet of claim 1, wherein a hardness on the surface of the sheet measured using a Vickers hardness method is 0.1 Hv to 10 Hv larger than a hardness of the cross-section of the sheet and the hardness of the surface ranges from 130 Hv to 210 Hv.

8. The non-oriented electrical steel sheet of claim 1, wherein a W15/100 (W/kg) value measured using an Epstein method divided by the square of the thickness of the sheet is greater than or equal to 20 mm and less than or equal to 100 mm, wherein the W15/100 (W/kg) value refers to a loss generated when being excited at 1.5 T under a 100 Hz AC sinusoidal frequency condition.

9. The non-oriented electrical steel sheet of claim 6, wherein a Br value after annealing at 750° C. for 2 hours is greater than or equal to 1.75 (T) and relative permeability at $B_{0.5}$ is greater than or equal to 8000μ, wherein, $B_{0.5}$ is a strength of a magnetic field when being placed at 50 A/m and the relative permeability is $B_{0.5}/(50 \times 4 \times \pi \times 10^{-7})$.

* * * * *